US007510328B2

(12) United States Patent
Schneider et al.

(10) Patent No.: US 7,510,328 B2
(45) Date of Patent: Mar. 31, 2009

(54) RECLOSABLE PACKAGE HAVING SLIDER WITH PULL TAB

(75) Inventors: John H. Schneider, Frankfort, IL (US); Steven Ausnit, New York, NY (US)

(73) Assignee: Illinois Tool Works Inc., Glenview, IL (US)

( * ) Notice: Subject to any disclaimer, the term of this patent is extended or adjusted under 35 U.S.C. 154(b) by 10 days.

(21) Appl. No.: 10/262,723

(22) Filed: Oct. 2, 2002

(65) Prior Publication Data

US 2004/0066989 A1 Apr. 8, 2004

(51) Int. Cl.
*B65D 33/16* (2006.01)
*B65D 65/28* (2006.01)

(52) U.S. Cl. ..... 383/204; 383/64; 383/61.2; 383/5

(58) Field of Classification Search ..... 24/400, 24/30.5 R, 399, 585.12, 572.1; 383/200, 383/203, 204, 207, 209, 210, 61.1, 61.2, 383/5, 64, 97, 69, 59; 493/213, 214
See application file for complete search history.

(56) References Cited

U.S. PATENT DOCUMENTS 3,234,614 A * 2/1966 Plummer ..... 24/400
3,259,951 A 7/1966 Zimmerman
3,780,902 A * 12/1973 Holc et al. ..... 220/270
3,790,992 A * 2/1974 Herz ..... 24/400
4,055,876 A 11/1977 Ackermann et al.
4,199,845 A * 4/1980 Ausnit ..... 24/399
4,890,935 A 1/1990 Ausnit et al.
4,927,271 A * 5/1990 Branson ..... 383/5
5,105,512 A 4/1992 Aussedat
5,681,115 A 10/1997 Diederich et al.
5,713,669 A * 2/1998 Thomas et al. ..... 383/204
5,775,812 A * 7/1998 St. Phillips et al. ..... 383/5
6,210,038 B1 * 4/2001 Tomic ..... 383/210
6,264,366 B1 * 7/2001 Custer ..... 383/5
6,273,607 B1 * 8/2001 Buchman ..... 383/5
6,286,999 B1 * 9/2001 Cappel et al. ..... 383/5
6,290,390 B1 * 9/2001 Buchman ..... 383/5
6,290,391 B1 * 9/2001 Buchman ..... 383/5
6,409,384 B1 6/2002 Provan et al.
6,733,622 B2 * 5/2004 McMahon et al. ..... 156/580.2
6,786,640 B2 * 9/2004 Schneider et al. ..... 383/5
6,929,594 B2 * 8/2005 Delisle ..... 493/212

FOREIGN PATENT DOCUMENTS

GB 1128475 9/1968

* cited by examiner

*Primary Examiner*—Robin Hylton
(74) *Attorney, Agent, or Firm*—Ostrager Chong Flaherty & Broitman P.C.

(57) ABSTRACT

A reclosable package comprises a receptacle having a mouth, a header that encloses a space above the mouth, and a slider-zipper assembly disposed in the mouth, the slider-zipper assembly comprising a slider mounted to a zipper. The header has a tear-away portion and respective remaining portions that flank at least a portion of the slider. A pull tab is coupled to and rotatable relative to the slider and projects above the upper edges of the remaining portions of the header. This arrangement enables the user to move the slider by grasping the pull tab. The user need not reach into the space between the remaining portions of the header to grasp the slider itself. In one embodiment, the pull tab is coupled to the sidewalls of the slider.

6 Claims, 6 Drawing Sheets

RECLOSABLE PACKAGE HAVING SLIDER WITH PULL TAB

BACKGROUND OF THE INVENTION

This invention generally relates to reclosable pouches, bags or other packages of the type in which material, such as foodstuff, detergent, etc., may be stored. In particular, the invention relates to reclosable packages having slider-operated zippers.

Reclosable bags are finding ever-growing acceptance as primary packaging, particularly as packaging for foodstuffs such as cereal, fresh vegetables, snacks and the like. Such bags provide the consumer with the ability to readily store, in a closed, if not sealed, package any unused portion of the packaged product even after the package is initially opened. To gain acceptance as a primary package for foodstuffs, it is virtually mandatory that the package exhibit some form of tamper evidence to protect the consumer and maintain the wholesomeness of the contained product. In addition, in many cases it is necessary that food product be hermetically packaged.

Reclosable fastener assemblies are useful for sealing thermoplastic pouches or bags. Such fastener assemblies typically include a plastic zipper and a plastic slider. Typically, the plastic zippers include a pair of interlockable profiled members that form a closure. As the slider moves across the profiles, the profiles are opened or closed. The profiles in plastic zippers can take on various configurations, e.g. interlocking rib and groove elements having so-called male and female profiles, interlocking alternating hook-shaped closure members, etc. Reclosable bags having slider-operated zippers are generally more desirable to consumers than bags having zippers without sliders because the slider eliminates the need for the consumer to align the interlockable zipper profiles before causing those profiles to engage.

In one type of slider-operated zipper assembly, the slider straddles the zipper and has a separating finger at one end that is inserted between the profiles to force them apart as the slider is moved along the zipper in an opening direction. The other end of the slider is sufficiently narrow to force the profiles into engagement and close the zipper when the slider is moved along the zipper in a closing direction. Other types of slider-operated zipper assemblies avoid the use of a separating finger. For example, U.S. Pat. No. 6,047,450 discloses a zipper comprising a pair of mutually interlockable profiled closure members, portions of which form a fulcrum about which the profiled closure members may be pivoted out of engagement when the bases of the profiled closure members are forced towards each other.

One problem with reclosable plastic bags of the foregoing type is that, if they are filled with a food product and then sold in a grocery store, the contents can be tampered with prior to purchase by the consumer. Therefore it is desirable to design such packages with a feature that provides evidence of tampering. One such tamper-evident feature is a top enclosure or header that encapsulates the slider-zipper assembly. Typically, means are provided for enabling a top portion of the header to be torn or cut off, thereby giving the consumer access to the slider. The tear line or cut line may be situated at an elevation higher than the top of the zipper so that the zipper does not interfere with tearing away or cutting off of the header top portion. In such cases, the remaining portions of the header on both sides of the zipper cover parts of the slider, thereby limiting the consumer's access to the slider.

It is known to provide a zipper slider with a grab tab that is fixed relative to the slider and projects upward from the top of the slider. When the tear-away portion of the header is removed, the consumer can move the slider by grasping the grab tab. In this case the header must allow for the upward projection of the grab tab, adding to the height of the header. There is a need for a reclosable package in which the slider has a tab that is movable between a storage position and a pulling position, thereby reducing the height of the header and the amount of material needed to construct the header. There is also a need for a slider having a pull tab that can be moved between a first position suitable for grasping by the user for pulling the slider in one direction and a second position suitable for grasping by the user for pulling the slider in the opposite direction.

BRIEF DESCRIPTION OF THE INVENTION

The invention is directed to slider-operated reclosable packages wherein the slider can be operated by means of a pull tab operatively coupled to the slider and movable between storage and pulling positions. The invention is also directed to a slider having a pull tab that can be moved between a first position suitable for grasping by the user for pulling the slider in one direction and a second position suitable for grasping by the user for pulling the slider in the opposite direction.

One aspect of the invention is a reclosable package comprising a receptacle having a mouth, a header that encloses a space above the mouth, and a slider-zipper assembly disposed in the mouth, the slider-zipper assembly comprising a slider mounted to a zipper, the header comprising first and second portions that flank at least a portion of the slider, and further comprising a pull tab coupled to and rotatable relative to the slider.

Another aspect of the invention is a reclosable package comprising a receptacle having a mouth, first and second mouth walls extending above the mouth, and a slider-zipper assembly disposed in the mouth, the slider-zipper assembly comprising a slider mounted to a zipper, wherein the first and second mouth walls flank at least a portion of the slider, and further comprising a pull tab coupled to and rotatable relative to the slider.

A further aspect of the invention is a reclosable package comprising: a receptacle having a mouth, the receptacle comprising first and second receptacle walls that are joined or connected to each other along three sides of the receptacle and that are not joined or connected to each other along the mouth; first and second interlockable profiled closure members respectively joined or connected to the first and second receptacle walls along the mouth, the mouth being closed when the first and second profiled closure members are interlocked with each other and the mouth being open when the first and second profiled closure members are disengaged from each other; a slider mounted to the first and second profiled closure members and movable therealong in either a mouth opening direction or a mouth closing direction; a pull tab coupled to and rotatable relative to the slider; and a header enclosing a space partially occupied by the slider and the first and second profiled closure members, the header comprising a first header wall disposed adjacent to the first profiled closure member and a second header wall disposed adjacent the second profiled closure member.

Yet another aspect of the invention is a device comprising a slider configured for operative coupling with a plastic zipper, a pull tab coupled to and rotatable relative to the slider, and breakable means for securing the pull tab to the slider.

Another aspect of the invention is a device comprising a slider configured for operative coupling with a plastic zipper and a pull tab coupled to and rotatable relative to the slider, wherein the slider comprises a throughhole, and the pull tab comprises a pair of arms having respective ends that overlap inside the throughhole.

A further aspect of the invention is an assembly comprising a zipper, a slider mounted to said zipper, a pull tab coupled to and rotatable relative to the slider, and breakable means for securing the pull tab to the zipper.

Another aspect of the invention is a device comprising a slider configured for operative coupling with a plastic zipper, the slider comprising first and second sidewalls, and a pull tab pivotably coupled to the sidewalls of the slider, wherein at least one of the sidewalls has at least one shoulder for limiting the range of pivoting of the pull tab relative to the slider.

Other aspects of the invention are disclosed and claimed below.

BRIEF DESCRIPTION OF THE DRAWINGS

Reference will now be made to the drawings in which similar elements in different drawings bear the same reference numerals.

DETAILED DESCRIPTION OF THE INVENTION

Figure 1:
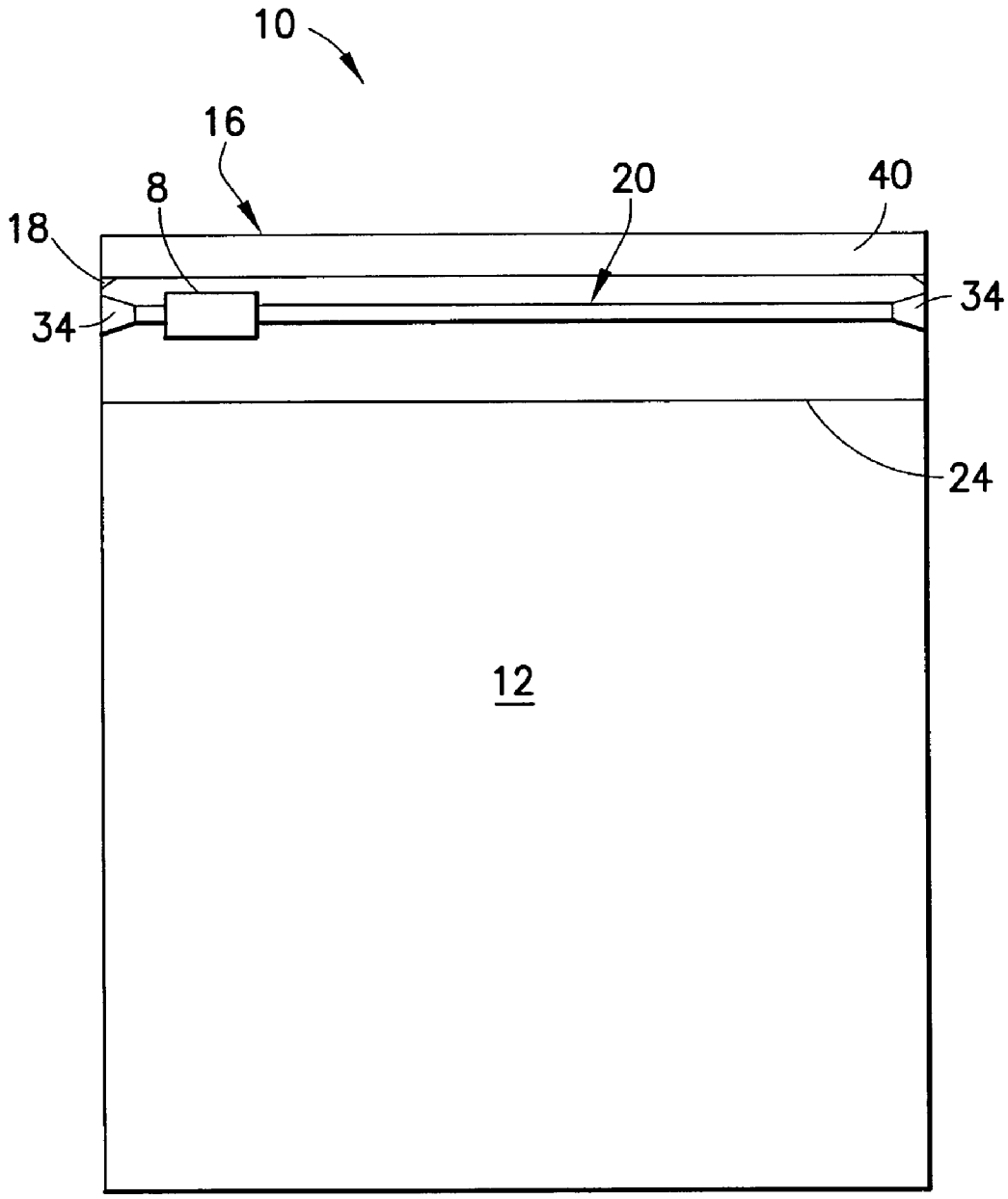
FIG. 1 is a drawing showing a front view of a conventional reclosable package having a slider-zipper assembly installed in the mouth of the package.
Figure 2:
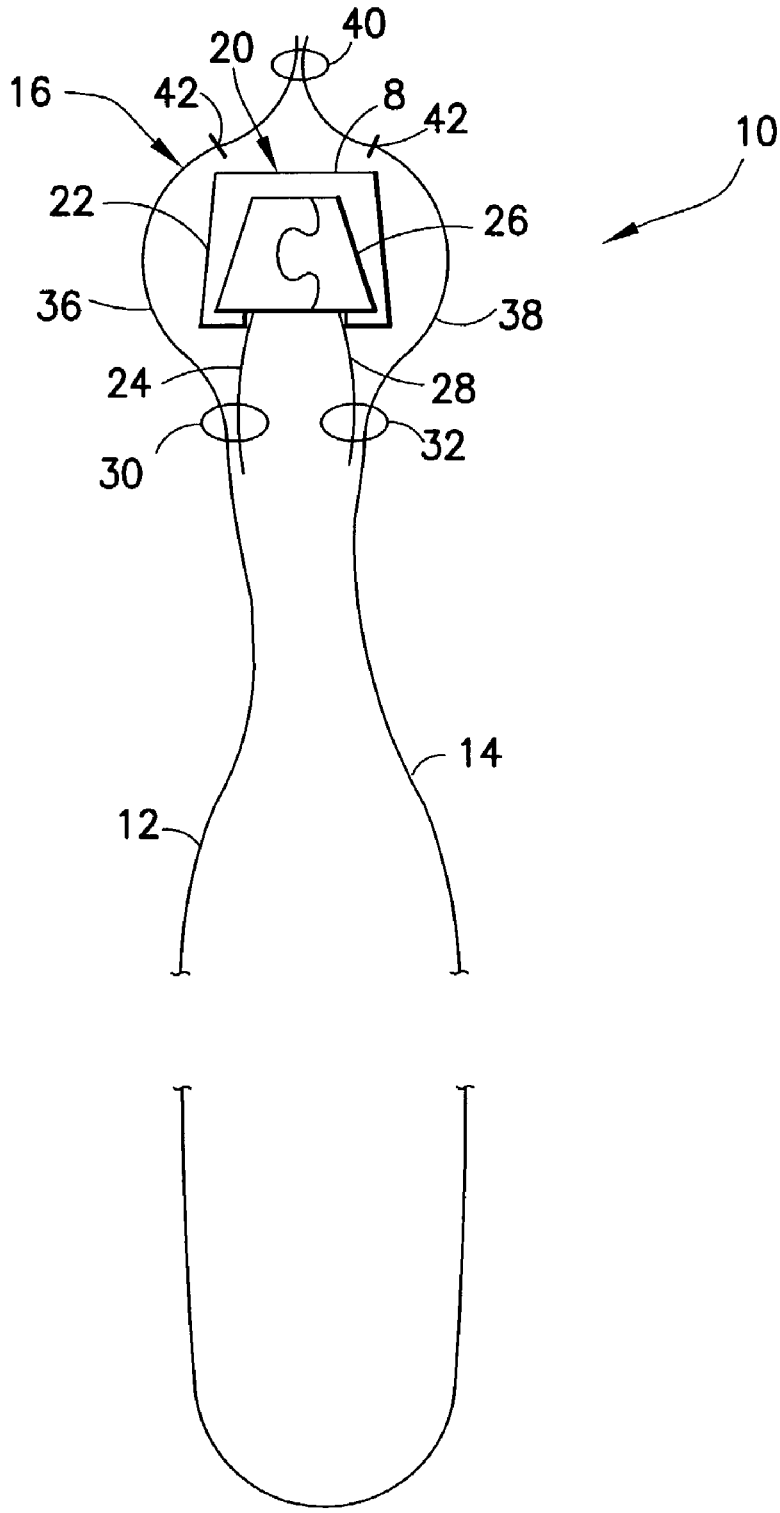
FIG. 2 is a drawing showing a sectional view of one type of reclosable bag having a slider-zipper assembly in a space enclosed by a header.

FIGS. 1 and 2 depict a reclosable package 10 comprising a receptacle with a mouth at the top, the receptacle being formed by a front wall 12 and a rear wall 14 that is opposite to the front wall. The front and rear walls are typically formed from clear thermoplastic film heat sealed as necessary to form hermetically sealed junctures for the various portions of the package, e.g., along the sides if folded along the bottom or along a central seam and along the bottom if folded along the sides. The receptacle walls 12 and 14 are formed of a suitable plastic film material for the product to be contained within the package. For example, the film may be a laminate or coextrusion comprising a gas barrier layer and/or a low-melting-point sealant layer.

Referring to FIG. 2, a plastic zipper 20 is situated in the mouth of the receptacle. The zipper 20 comprises a closure member 22 having a female profile and a closure member 26 having a male profile that interlocks with the female profile in the zipper section being closed as a slider 8 travels in the closing direction. The zipper 20 further comprises a zipper flange 24 having one end connected or joined to profiled closure member 22 and a zipper flange 28 having one end connected or joined to profiled closure member 26.

As seen in FIG. 2, the zipper flange 24 is secured to the bag front wall 12 by a permanent seal 30 proximal to the top of the bag, while zipper flange 28 is secured to the bag rear wall 14 by a permanent seal 32. The permanent seals 30 and 32 are indicated by ovals. It should be appreciated that each permanent seal is a band of joined, e.g., fused, material that extends from one side seal of the bag to the other side seal, thereby securing the zipper to the bag along the width of the bag. The permanent seals 30 and 32 are generally parallel to each other and may be formed by any conventional method, such as conduction heat sealing.

The slider 8 is mounted to the profiled closure members 22 and 26 of the zipper 20 to facilitate zipper opening and closing. FIG. 1 shows the slider 8 in a position corresponding to closure of the zipper 20. Moving the slider 8 toward the right-hand side would disengage the interlockable closure members of the zipper and moving the slider back to the closed position shown in FIG. 1 would bring the interlockable closure members 22, 26 of the zipper 20 into full engagement once again. For proper functioning, the interlockable closure members 22 and 26 have spot seals or ultrasonic stomps 34 at the ends of the zipper halves. These seals ensure the zipper strips will not come apart during use and provide end stops for stopping the slider 8. The slider 8 is preferably made of a resilient plastic material, such as delrin, polypropylene, PBT, etc.

The slider 8 has a closing end and an opening end. The closing end is shaped to force the profiled closure members 22 and 26 into engagement when the slider 8 travels in the closing direction. The closing end is so-called because it is the end where the zipper profiled closure members 22, 26 are forced into engagement when the slider 8 is moved in the closing direction, i.e., opposite to the closing end of the slider. During slider travel in the closing direction, the closing end is the trailing end of the slider.

Prior to opening of the package by the consumer, the slider-zipper assembly is frequently covered on the consumer side by an enclosed header 16 that is hermetically sealed. Referring to FIG. 2, the sealed header 16, which provides a tamper-evident feature, comprises front and rear header walls 36 and 38 that are integrally formed with the front and rear walls 12 and 14, respectively, of the receptacle, and are sealed to each other along zone 40 at the top of the package. The numeral 40 in FIG. 1 designates a hard seal, i.e., a seal that is not intended to be broken, at the top of the header. Alternatively, the header may comprise a pair of opposing panels, the bottom edges of the header panels being joined to the top edges of the receptacle walls by conduction heat sealing, and the top edges of the panels being heat sealed to each other. In accordance with a further alternative, the bottom edges of the header and the top edges of the receptacle can be respectively heat sealed to the respective zipper flanges. In accordance with a further alternative, instead of a header having a top seal, the opposed header walls 36 and 38 may be formed by folding a piece of film and attaching the edges to the top edges of walls 12 and 14 of the receptacle.

The sealed header 16 preferably has respective tear notches 18 formed in each side seal of the header, where the consumer can initiate tearing off of the sealed header from the package. The tear notches may be formed at an elevation above the top of the zipper so that the zipper does not interfere with tearing off of the top portion of the header at the height of the tear notch. Slits can be used instead of notches. Optionally, lines of weakened tear resistance 42 (see FIG. 2) can be formed in the header walls or panels at the height of the tear notches, extending across the width of the header. The lines 42 of weakened tear resistance may be lines of spaced perforations, score lines, or thinned-die lines with less plastic extruded along the lines. The topmost portion of the header will be severed along the lines of weakened tear resistance as the consumer tears open the header. Alternatively, instead of providing tear notches, horizontal dashed or dotted lines can be imprinted on the header panels at a height above the top of the zipper, indicating where the consumer should cut the package to open it.

It should be appreciated that the front panel or wall 36 of the header 16 and the front wall 12 of the receptacle are shown in FIG. 1 as being made of relatively transparent thermoplastic material. Therefore, the slider-zipper assembly is visible through the clear walls and has not been depicted as hidden. Obviously, the degree of optical transparency is irrelevant to the present invention. The bag making film may be transparent, opaque or any degree of translucence therebetween.

Figure 3:
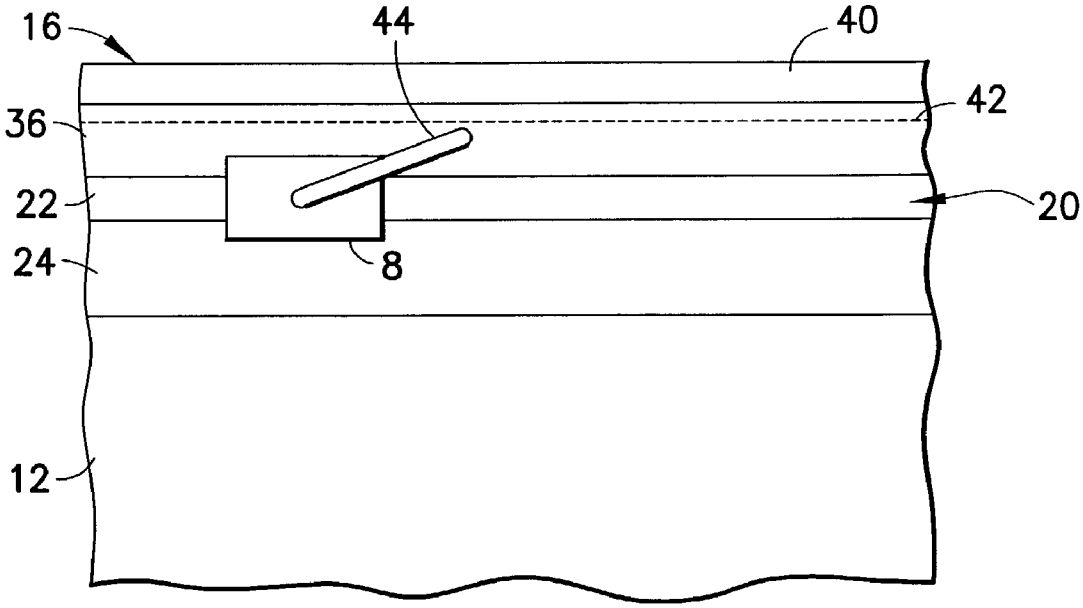
FIG. 3 is a drawing showing a fragmentary front view of a portion of a reclosable package having a header and a pull tab pivotably coupled to a slider in accordance with one embodiment of the invention. The dashed line indicates a line of weakened tear resistance formed in the header wall.
Figure 4:
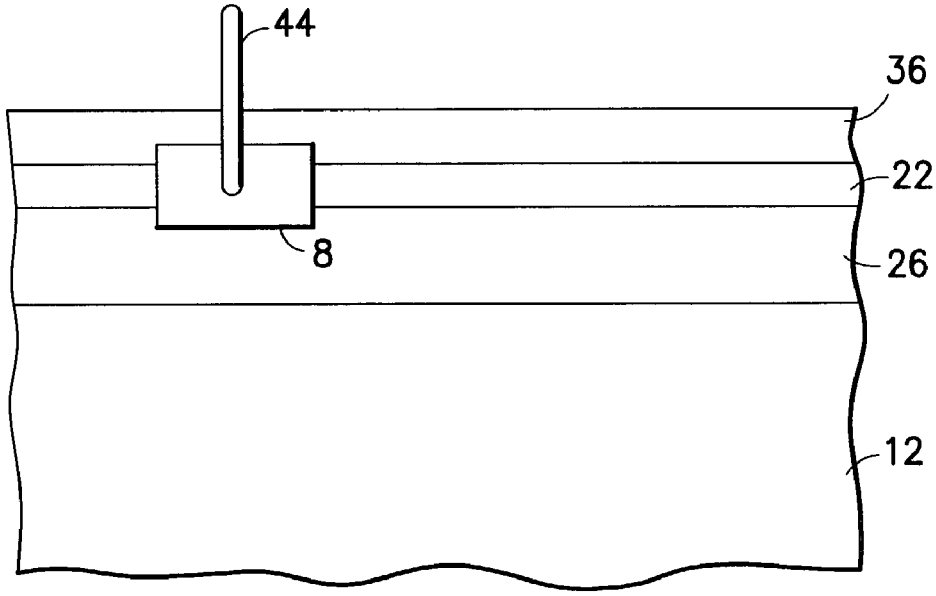
FIG. 4 is a drawing showing a fragmentary front view of the same portion of the same reclosable package depicted in FIG. 3, now with the tearaway portion of the header removed and with the pull tab pivoted upward to project above the upper edges of the remnants of the torn header.

FIGS. 3 and 4 shows a slider 8 having a pull tab 44 pivotably coupled to the sidewalls of the slider in accordance with one embodiment of the invention. The pull tab is shown in a storage position in FIG. 3 and in a grasping or pulling position in FIG. 4. The header 16 is shown intact in FIG. 3, with the tear lines 42 not severed; the header is shown in FIG. 4 with a tear-away portion removed at the tear lines. The structural relationship of the slider 8 and the pull tab 44 are best seen in FIGS. 5 and 6.

Figure 5:
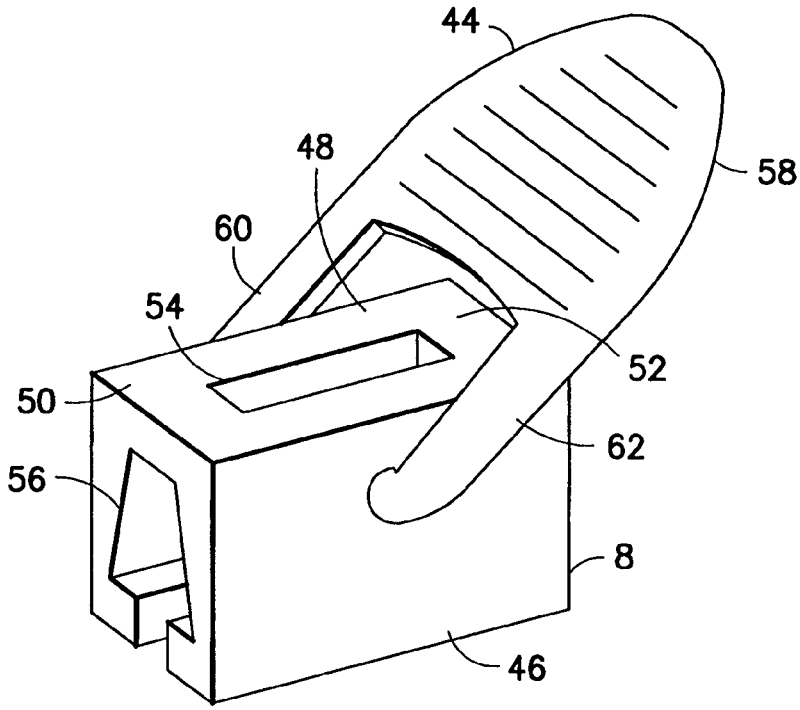
FIG. 5 is a drawing showing an isometric view of the slider with pull tab incorporated in the embodiment depicted in FIGS. 3 and 4. The pull tab is shown at an angular position of about 45 degrees relative to the direction of slider movement along a zipper (not shown).

Referring to FIG. 5, the slider comprises a pair of sidewalls 46 and 48 connected at the top of the slider and at opposing ends thereof by a pair of cross beams 50 and 52, which form a window 54 at the top of the slider. The closing end of the slider is visible in FIG. 5, while the opening end is not. The closing end has a trapezoidal window 56 corresponding to the profile of the closed zipper (see FIG. 2), while the opening end has a rectangular window (not shown) in which the zipper closure members are partially disengaged from each other. Zippers with other profiles will have sliders that have different opening and closing ends.

Figure 6:
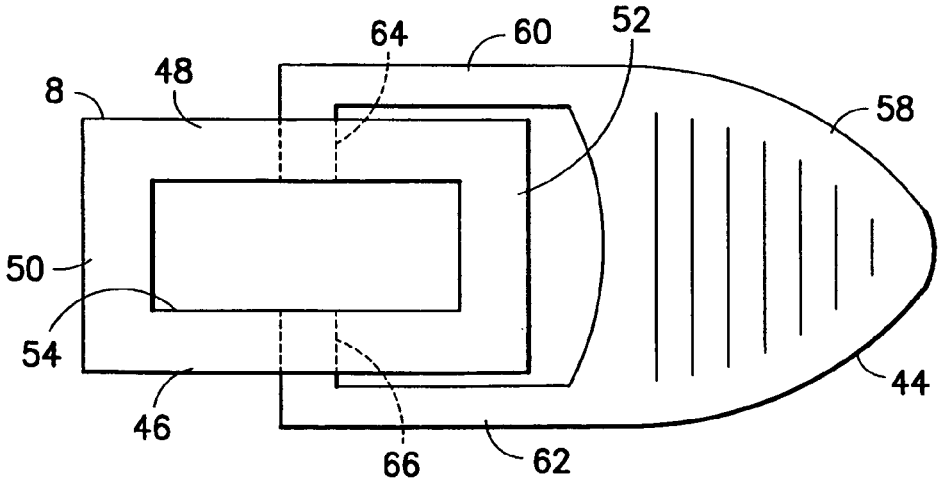
FIG. 6 is a drawing showing an top view of the slider with pull tab incorporated in the embodiment depicted in FIGS. 3 and 4. The pull tab is shown at an angular position generally parallel to the direction of slider movement.

As best seen in FIG. 6, the pull tab 44 comprises a grasping pad 58 that is ergonomically designed for grasping between a thumb and an index finger. For example, the grasping pad may be slightly concavely curved on both sides. Optionally, the opposing surfaces of the grasping pad may be knurled or serrated to make it easier to grasp, thereby reducing the chance that the pad will slip out of the grasp of the consumer during an attempt to move the slider in the opening or closing direction.

Still referring to FIG. 6, the pull tab 44 further comprises a pair of arms 60 and 62 that are generally parallel to each other and have respective ends connected to the grasping pad 58; and a pair of inwardly directed circular cylindrical projections or pins 64 and 66 respectively connected to the distal ends of arms 60 and 62. The pins 64 and 66 are seated in respective circular cylindrical bores formed in the side walls 46 and 48, as seen in FIG. 6. The axes of the bores are collinear. The diameter of each bore is only slightly greater than the diameter of the pins, the bores acting as bearing surfaces that hold the pins in place while allowing the pins to rotate. Alternatively, circular cylindrical recesses that open on the exterior surfaces of the slider sidewalls (and that are closed on the interior of the sidewalls) could be used in place of through-holes or bores. The arms 60 and 62 are sufficiently flexible that the pins 64 and 66 can be spread apart until the gap between the ends of the pins exceeds the width of the sidewalls. The pins are then moved until they overlie the bores or recesses formed in the sidewalls. The flexed arms can then be released, allowing the pins to slide into the bores or recesses, thereby pivotably coupling the pull tab to the slider.

When the package is unopened, i.e., the header is intact, the pull tab can occupy an angular position whereat the grasping pad rests on top of the zipper, as seen in FIG. 3. However, if the header clearance allows, the pull tab may occupy a storage position higher than that shown in FIG. 3 (i.e., a position not in contact with the zipper), the higher angular position being limited by abutment of the grasping pad against the roof of the sealed header.

As seen in FIG. 4, when the tear-away top portion of the sealed header is severed along the aforementioned tear lines, the remnants of the header walls 36 and 38 flank at least a portion of the slider 8 on both sides thereof. In the absence of a pull tab, it is difficult for the consumer to access and grasp the slider when it is buried between the header wall remnants. This difficulty arises because the upstanding header wall remnants cover the slider on both sides thereof and the user must separate the wall remnants from the slider before the slider can be grasped and then moved. The pull tab 44 enables the consumer the move the slider without reaching between the header wall remnants. As seen in FIG. 4, the pull tab can be rotated to an angular position whereat a distal end of the pull tab is situated higher than the upper edges of the header remnants. This enables the consumer to move the slider, without interference from the header remnants, by manipulating a pull tab that projects above the header remnants.

FIG. 4 shows the use of a slider with pull tab in the situation wherein a topmost portion of a header has been torn away, leaving the slider flanked by remnants of the header walls. However, a person skilled in the art will readily appreciate that a reclosable package could be manufactured with a pair of upstanding mouth walls or panels, respectively integrally formed with or joined to the receptacle walls and sealed to each other at the opposing ends of the mouth, without the use of an enclosed header. In the latter situation, the state of the reclosable package would be the same as that depicted in FIG. 4. In accordance with an alternative embodiment, instead of an enclosed header with tear lines, the one-time breakable seal can be formed by a peel seal that joins the upper edges of opposing upstanding mouth walls or panels. Such a peel seal would be positioned above the slider and zipper, at the same height as that of the hard seal 40 depicted in FIG. 3.

Figure 7:
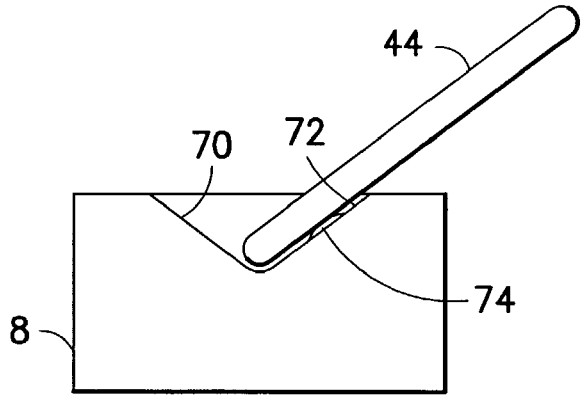
FIG. 7 is a drawing showing a side view of a slider with pull tab in accordance with yet another embodiment of the invention.

In the embodiments disclosed above wherein the pull tab has a pair of arms that straddle the slider sidewalls and a pair of projections pivotably seated in bores or recesses formed in the slider sidewalls, the slider can optionally be provided with shoulders 70 and 72 (see FIG. 7) or other protrusions strategically located on the exterior of the sidewalls to act of stops that limit the range of pivoting of the pull tab. In addition, the pull tab can be secured in one of the limit positions, thereby locking the pull tab in place during package manufacture. For example, the arms of the pull tab could be tack sealed, glued or otherwise adhered to opposing surfaces of the shoulders or connected to the shoulders by breakable molded connections. For the sake of illustration, FIG. 7 shows a tack seal 74 by means of which the arm of the pull tab 44 is adhered to the opposing surface of shoulder 72. Alternatively, the pull tab could be taped in the limit position. In cases where the grasping pad of the pull tab cannot clear the edge of the slider, but rather sits on the roof of the slider, the grasping pad can be glued, tacked or taped to the slider roof or connected to it by a breakable molded connection.

Figure 8:
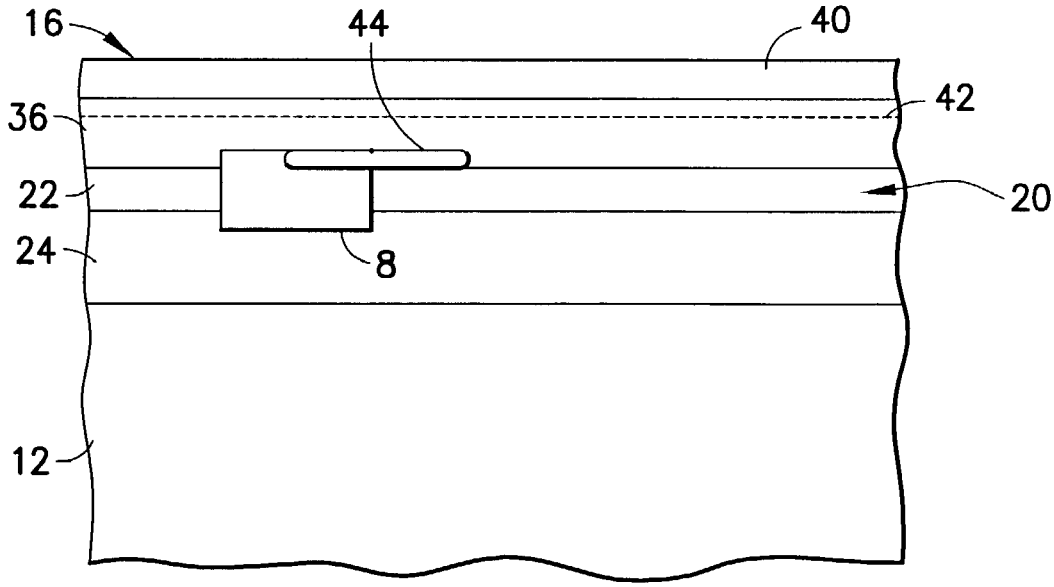
FIG. 8 is a drawing showing a fragmentary front view of a portion of a reclosable package having a header and a pull tab pivotably coupled to a slider in accordance with a further embodiment of the invention.
Figure 9:
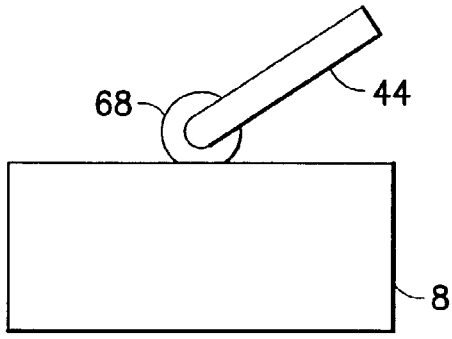
FIGS. 9-11 are drawings showing side views of sliders with pull tabs in accordance with further embodiments of the invention.

Another embodiment of the invention is depicted in FIG. 8. In this embodiment, the pivot axis of the pull tab is located close to the top of the slider, the arms being again pivotably mounted in bores or recesses formed in the slider sidewalls. Preferably the pivot point is higher than the top of the zipper profile so that the tab 44 can be rotated to a generally horizontal angular position (as seen in FIG. 8), with the grasping pad lying on and abutting the top surface of the zipper 20. In this situation, the pull tab can be secured to the top of the zipper, e.g., by tacking, gluing or otherwise adhering, or taped to the zipper. During manufacture, the pull tab would be secured in the horizontal locked position. After the package has been torn open along the tear lines 42 by the consumer, the consumer can unlock and lift the pull tab, and rotate it upward to a position whereat a substantial portion of the pull tab lies above the tear line. In this position, the slider can be easily manipulated to open or close the zipper as desired.

Because the tear lines in the header of the disclosed embodiments are higher than the tops of the slider and zipper, these tear lines can be readily made in the final package making step, without the need to use special equipment that avoids damage to the zipper or slider. The inventive aspects disclosed herein have application in different types of pouches, including but not limited to fin seal pillow pouches, side-gusset pouches, three-sided seal pouches and bottom gusset pouches.

Figure 10:
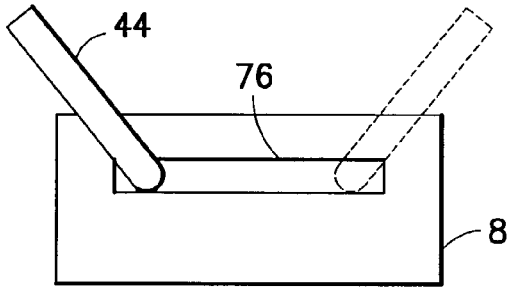
Figure 11:
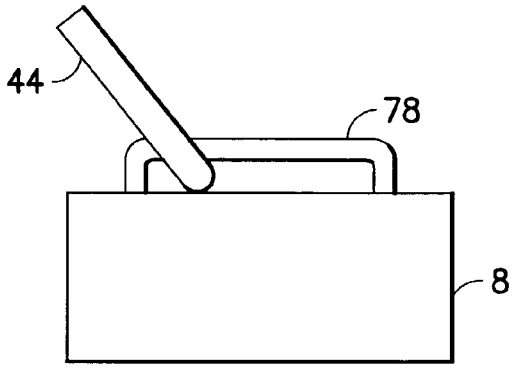
Figure 12:
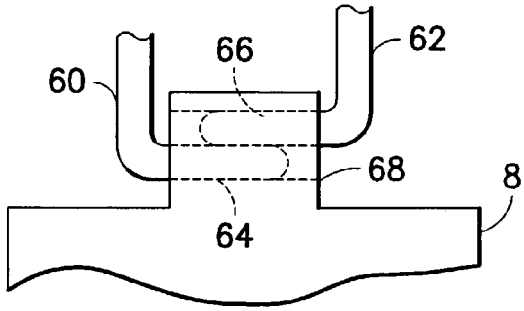
FIG. 12 is a drawing showing an end view of the coupling between a slider and a pull tab wherein the pull tab has a pair of arms with ends that overlap.

Other embodiments of the invention are depicted in FIGS. 9-12. In one embodiment, a pivot mounting 68 is integrally molded to the roof of the slider and the pins at the ends of the pull tab arms are inserted in opposing ends of a circular cylindrical bore in the pivot mounting 68. In other embodiments shown in FIGS. 10 and 11, the pull tab is both translatable and rotatable relative to the slider. In the embodiment of FIG. 10, respective horizontal slots 76 (only one is visible) are formed in the slider sidewalls running nearly the full length of the slider and the pins at the ends of the pull tab arms project into and are guided by the slots 76 so that they can displace from one end of the slot to the other. This allows the pull tab to be located in the best position for closing (at the front of the slider) and for opening (at the back of the slider. Instead of a pair of slots being formed in the respective sidewalls of the slider, a single slot can be formed by attaching or integrally molding a bridge 78 on the roof of the slider as shown in FIG. 11. For the embodiments shown in FIGS. 9 and 11, the pins 64 and 66 at the ends of the pull tab arms 60 and 62 should overlap inside the throughhole, as shown in FIG. 12.

While the invention has been described with reference to preferred embodiments, it will be understood by those skilled in the art that various changes may be made and equivalents may be substituted for members thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

The invention claimed is:

1. A reclosable package comprising a receptacle having a mouth, a header that encloses a space above said mouth, a slider-zipper assembly disposed in said mouth, said slider-zipper assembly comprising a slider mounted to a zipper comprising end stops for stopping said slider at both ends thereof, a pull tab coupled to and rotatable relative to said slider, and breakable means for securing said pull tab to said slider in an initial configuration, wherein said header comprises first and second portions that flank at least a portion of said slider, and a third portion disposed higher than said first and second portions of said header; wherein said pull tab is rotatable from a lowermost angular position to an uppermost angular position, a distal end of said pull tab being situated higher than an upper edge of said header formed by removal of said third portion when said pull tab is in said uppermost angular position; wherein prior to removal of said third portion, said header comprises a line of weakened tear resistance where said upper edge will be formed, and said distal end of said pull tab is situated lower than said line of weakened tear resistance when said pull tab is in said lowermost angular position; and wherein said slider comprises first and second sidewalls, said first sidewall comprising a first slot and said second sidewall comprising a second slot, and said pull tab comprises first and second projections that project into and are movable along the lengths of said first and second slots respectively, said first and second projections being loosely seated in said first and second slots respectively for allowing rotation and being guided by said first and second slots respectively during displacement.

2. A reclosable package comprising a receptacle having a mouth, a header that encloses a space above said mouth, a slider-zipper assembly disposed in said mouth, said slider-zipper assembly comprising a slider mounted to a zipper comprising end stops for stopping said slider at both ends thereof, a pull tab coupled to and rotatable relative to said slider, and breakable means for securing said pull tab to a top of said zipper in an initial configuration, wherein said header comprises first and second portions that flank at least a portion of said slider, and a third portion disposed higher than said first and second portions of said header; wherein said pull tab is rotatable from a lowermost angular position to an uppermost angular position, a distal end of said pull tab being situated higher than an upper edge of said header formed by removal of said third portion when said pull tab is in said uppermost angular position; wherein prior to removal of said third portion, said header comprises a line of weakened tear resistance where said upper edge will be formed, and said distal end of said pull tab is situated lower than said line of weakened tear resistance when said pull tab is in said lowermost angular position; and wherein said slider comprises first and second sidewalls, said first sidewall comprising a first slot and said second sidewall comprising a second slot, and said pull tab comprises first and second projections that project into and are movable along the lengths of said first and second slots respectively, said first and second projections being loosely seated in said first and second slots respectively for allowing rotation and being guided by said first and second slots respectively during displacement.

3. A reclosable package comprising a receptacle having a mouth, a slider-zipper assembly disposed in said mouth, and first and second header walls disposed on opposite sides of a space above said mouth, said slider-zipper assembly comprising a slider mounted to a zipper comprising end stops for stopping said slider at both ends thereof, a pull tab coupled to and rotatable relative to said slider, and breakable means for maintaining said pull tab in a first limit position relative to said slider when said breakable means is not broken in an initial configuration, wherein said first and second header walls flank at least a portion of said slider, and said pull tab is rotatable from a lowermost angular position to an uppermost angular position, a distal end of said pull tab being situated higher than respective upper edges of said first and second header walls when said pull tab is in said uppermost angular position, and said distal end of said pull tab is situated lower than said upper edges of said first and second header walls when said pull tab is in said lowermost angular position, wherein said pull tab is pivotably coupled to said slider and has a pivot axis situated approximately midway between a top and a bottom of said slider, and said pull tab is pivotable between said first limit position and a second limit position when said breakable means is broken.

4. The package as recited in claim 3, wherein said pivot axis is situated approximately midway between opening and closing ends of said slider.

5. A reclosable package comprising a receptacle having a mouth, a slider-zipper assembly disposed in said mouth, and first and second header walls disposed on opposite sides of a space above said mouth, said slider-zipper assembly comprising a slider mounted to a zipper comprising end stops for stopping said slider at both ends thereof, a pull tab coupled to and rotatable relative to said slider, and breakable means for securing said pull tab to said zipper in an initial configuration, wherein said first and second header walls flank at least a portion of said slider, and said pull tab is rotatable from a lowermost angular position to an uppermost angular position, a distal end of said pull tab being situated higher than respective upper edges of said first and second header walls when said pull tab is in said uppermost angular position, and said distal end of said pull tab is situated lower than said upper edges of said first and second header walls when said pull tab is in said lowermost angular position, and wherein said pull tab is pivotably coupled to said slider and has a pivot axis situated approximately midway between a top and a bottom of said slider.

6. The package as recited in claim 5, wherein said pivot axis is situated approximately midway between opening and closing ends of said slider.

* * * * *